US006319318B1

(12) United States Patent
Pekarek et al.

(10) Patent No.: US 6,319,318 B1
(45) Date of Patent: Nov. 20, 2001

(54) APPARATUS FOR DISPENSING TOWELS

(76) Inventors: Scott D. Pekarek; Sheila R. Pekarek, both of 1704 Raymond Rd., Garland, NE (US) 68360

( * ) Notice: Subject to any disclaimer, the term of this patent is extended or adjusted under 35 U.S.C. 154(b) by 0 days.

(21) Appl. No.: 09/409,917

(22) Filed: Sep. 30, 1999

(51) Int. Cl.[7] ..... B05C 1/08
(52) U.S. Cl. ..... 118/249; 118/256; 118/258
(58) Field of Search ..... 118/249, 256, 118/258; 68/175, 202; 422/292

(56) References Cited

U.S. PATENT DOCUMENTS

| | | | | |
|---|---|---|---|---|
| 3,388,953 | * | 6/1968 | Browning . | |
| 4,106,433 | * | 8/1978 | Fernando et al. | 118/212 |
| 4,392,028 | | 7/1983 | Saxton . | |
| 4,575,891 | | 3/1986 | Valente . | |
| 4,747,365 | * | 5/1988 | Tusch | 118/221 |
| 4,984,530 | * | 1/1991 | Dutton | 118/43 |
| 4,991,538 | * | 2/1991 | Davids et al. | 118/231 |
| 4,998,984 | | 3/1991 | McClendon . | |
| 5,092,013 | | 3/1992 | Genovese, Jr. . | |
| 5,159,735 | | 11/1992 | Owens et al. . | |
| 5,462,197 | | 10/1995 | Pound . | |
| 5,473,789 | | 12/1995 | Oster . | |
| 5,697,577 | * | 12/1997 | Ogden | 242/598.6 |

* cited by examiner

*Primary Examiner*—Laura Edwards
(74) *Attorney, Agent, or Firm*—Dale J. Ream

(57) ABSTRACT

An apparatus for selectably dispensing wet and dry tissues comprises a housing which defines an interior space. A pair of spaced apart hubs are mounted within the interior space of the housing for pivotally holding a roll of tissue therebetween, a free end of the tissue extending from the housing. The dispensing apparatus includes a first roller having a disinfectant liquid thereon. The dispensing apparatus further includes a second roller mounted within the interior space and selectably movable between a first position bearing against the first roller and a second position displaced from the first roller. The tissue is sandwiched between the first and second rollers such that the tissue is wetted with the disinfectant liquid when it is drawn through the housing with the second roller in the first position.

19 Claims, 7 Drawing Sheets

APPARATUS FOR DISPENSING TOWELS

BACKGROUND OF THE INVENTION

This invention relates to a tissue dispenser and, more particularly, to a dispenser which selectably dispenses dry tissue or tissue wetted with a disinfectant solution.

Restrooms accessible for public use, such as those in gas stations, restaurants, airports, schools, parks, highway rest areas, ball parks, and the like, are often visibly unsanitary. Toilet seats, in particular, are frequently found to be unhygienic for contact with one's skin. Unsanitary public restroom facilities pose many health risks which could be avoided by the availability of a convenient and effective means for sanitizing a toilet seat prior to use.

Disinfectant wipes are known in the art for cleaning unsanitary surfaces. Devices for dispensing dry towels are equally well known. It is desirable, however, to have a dispenser that can selectably dispense a tissue wetted with a disinfectant solution or a dry towel to allow a user of a public restroom to sanitize an unhygienic toilet seat and then dry the seat prior to use.

SUMMARY OF THE INVENTION

The dispensing apparatus constructed in accordance with the present invention utilizes a housing that can be mounted to a wall or partition of a restroom stall for selectably dispensing wet or dry tissues. A pair of hubs are mounted within the interior space of the housing for pivotally holding a roll of tissue or towels. A free end of the tissue extends through an opening in a front wall of the dispenser housing. The housing further includes a cartridge having a roller which communicates with a reservoir of liquid disinfectant therein. A second roller is mounted within the interior space of the housing and is selectably movable by a user either to bear against the cartridge roller or to be displaced therefrom. The tissue is sandwiched between the rollers when the second roller is positioned to bear against the cartridge roller. Accordingly, the tissue is wetted with the disinfectant liquid as it is drawn through the dispenser in this position. Dry tissue is dispensed when the second roller is displaced from the cartridge roller. Tissue is drawn through the dispenser by a pair of pinch rollers. The pinch rollers are coupled to a crank handle which extends through one side of the housing.

Therefore, it is a general object of this invention to provide a dispenser which can selectively dispense a wet or dry tissue for sanitizing a toilet seat prior to use.

Another object of this invention is to provide a dispenser, as aforesaid, which can be mounted to a wall or partition of a restroom facility.

Still another object of this invention is to provide a dispenser, as aforesaid, in which the tissue can be wetted with a disinfectant liquid having anti-bacterial, anti-viral, or anti-fungal properties.

A further object of this invention is to provide a dispenser, as aforesaid, in which quantities of tissue or disinfectant are removable and replaceable.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

Figure 1:
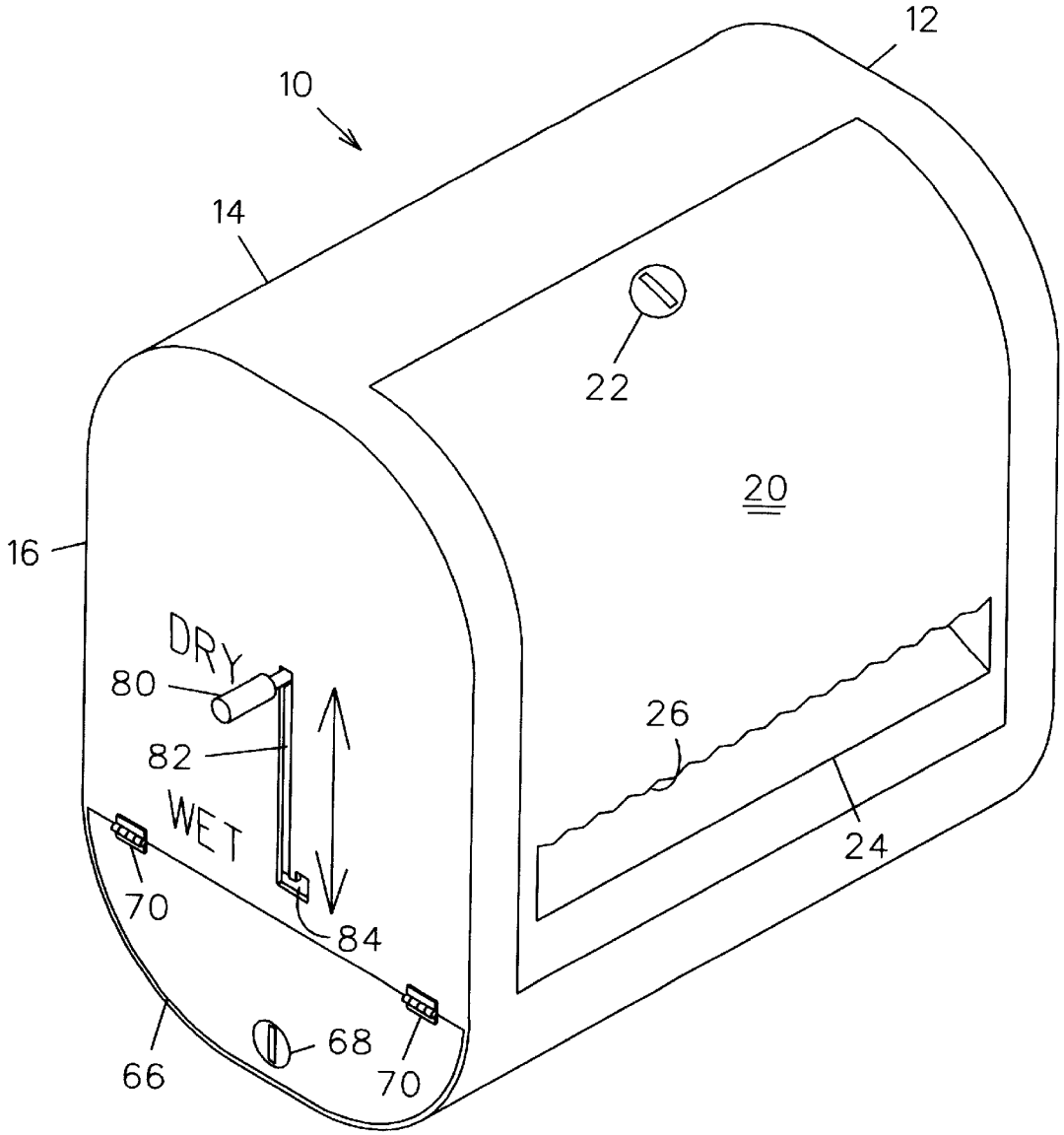
FIG. 1 is a perspective view of the dispensing apparatus according to the present invention configured to dispense a dry tissue.
Figure 2:
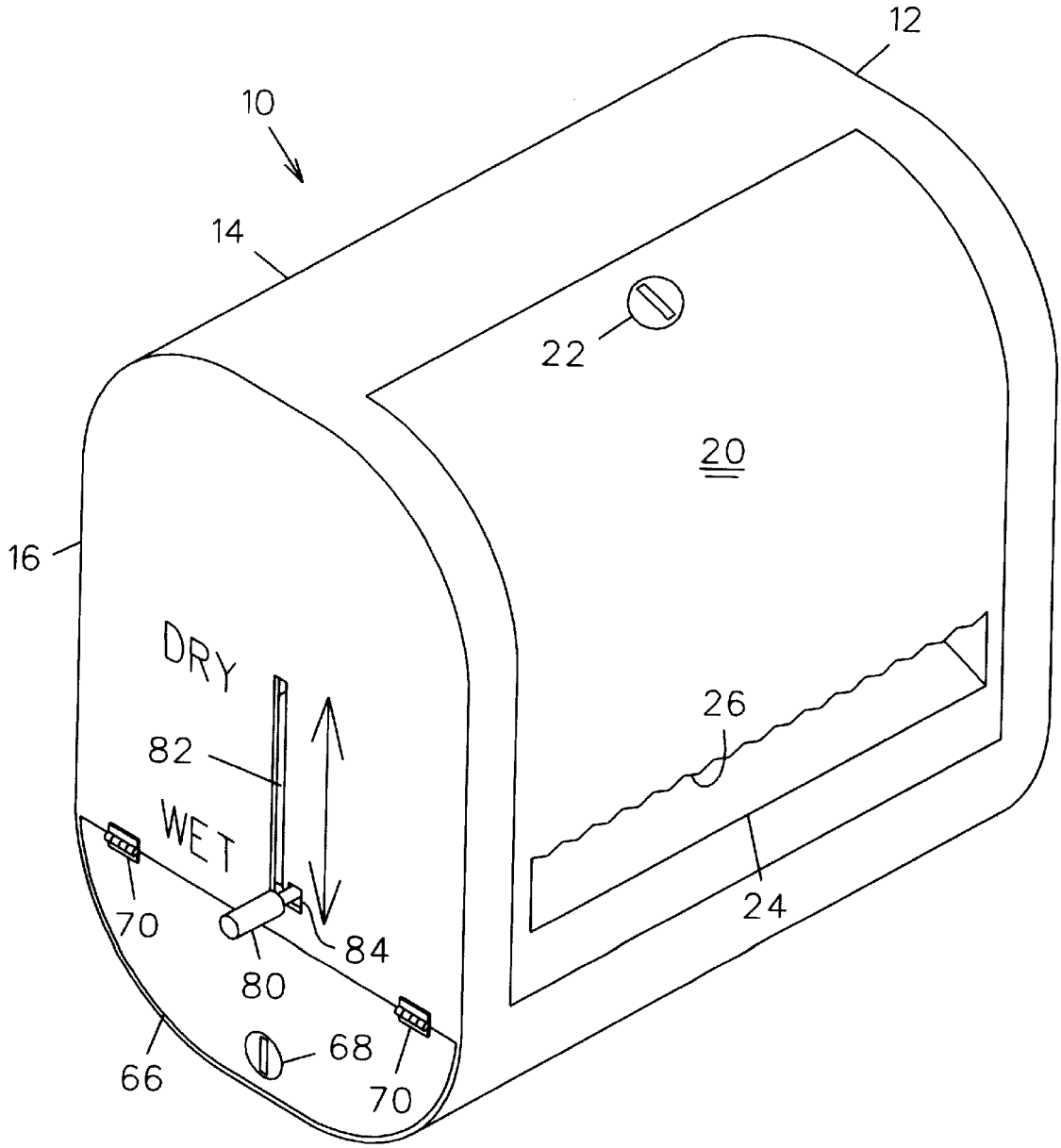
FIG. 2 is a perspective view of the dispensing apparatus as in FIG. 1 configured to dispense a wet tissue.
Figure 3:
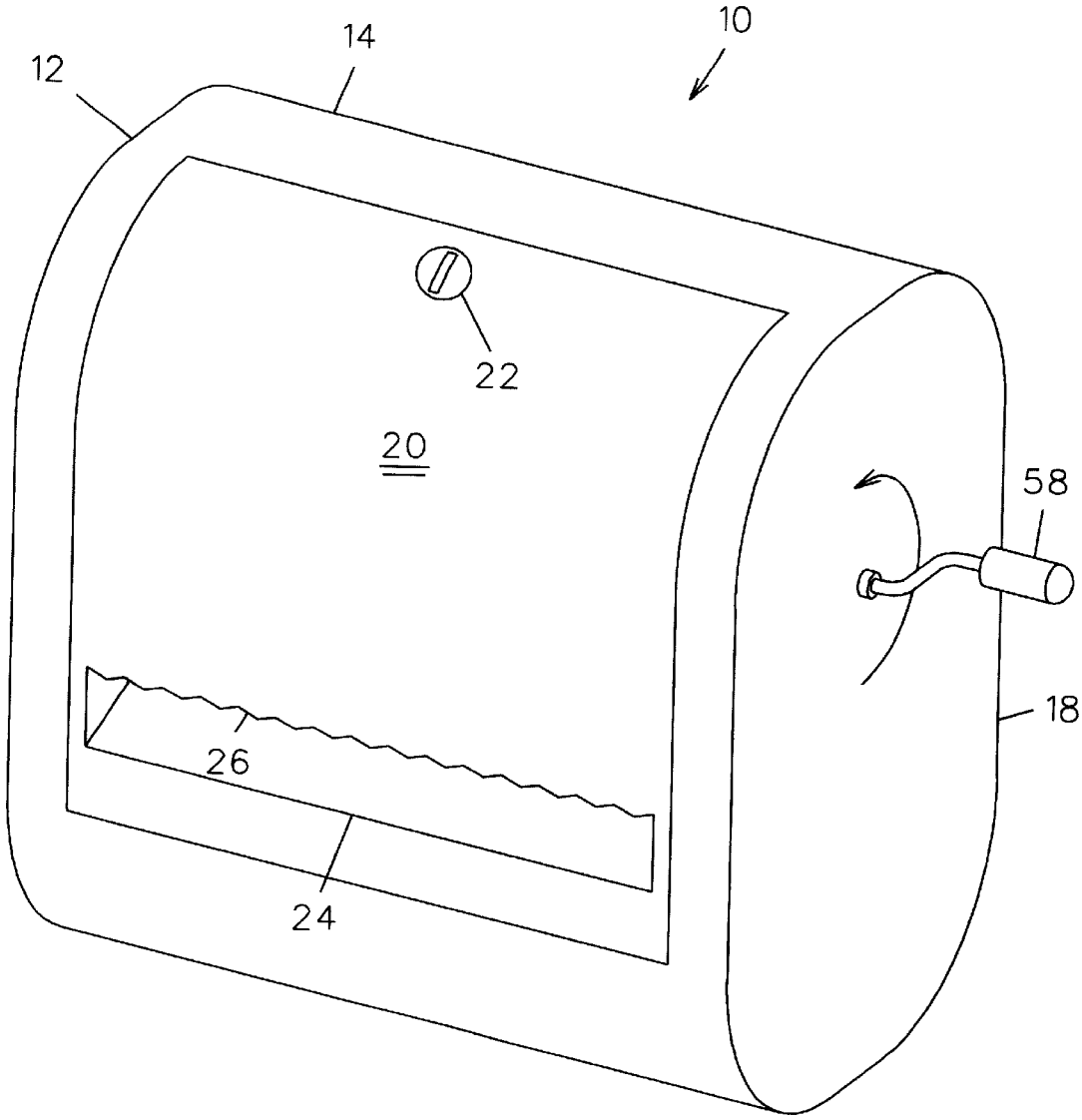
FIG. 3 is a right perspective view of the dispensing apparatus.
Figure 4:
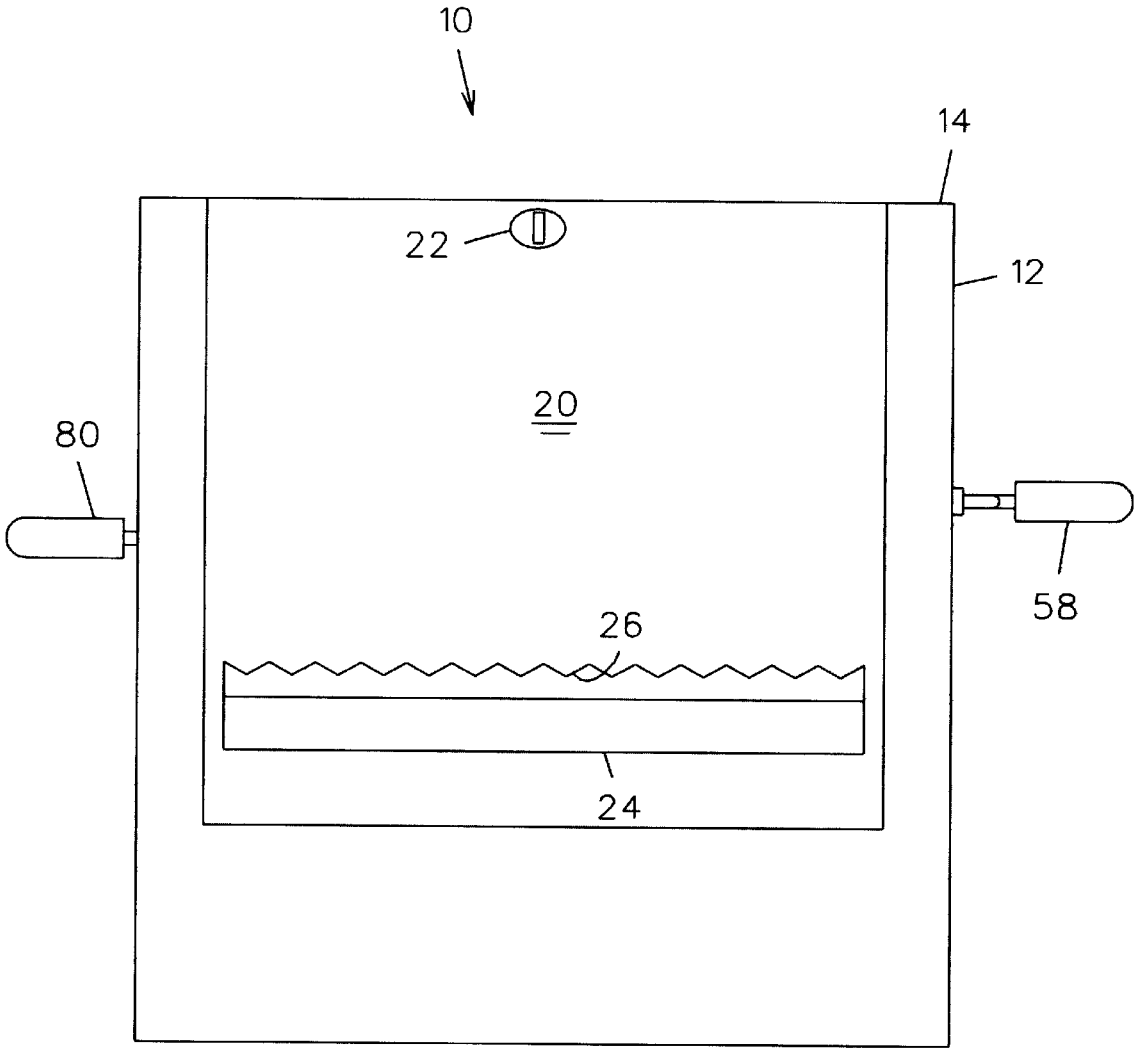
FIG. 4 is a front view of the dispensing apparatus.

Turning more particularly to the drawings, FIGS. 1–4 show a dispensing apparatus 10 having a housing 12 adapted to be mounted to a wall or partition of a stall in a restroom facility. The housing 12 is preferably constructed of a rigid plastic material although a metal construction would also be suitable. The housing 12 includes a generally elliptical body portion 14 having first 16 and second 18 opposing side walls. The housing 12 defines a hollow interior space. A front door 20 is pivotally coupled to the body portion 14 of the housing 12 with hinges or like fasteners. The front door 20 also includes a lock 22 for providing limited access to the interior of the housing 12. The front door 20 includes an elongated opening 24 extending longitudinally across the door 20. The upper edge 26 of the opening 24 is serrated such that a portion of tissue can be torn from the roll of tissue, as to be described more fully below.

Figure 6:
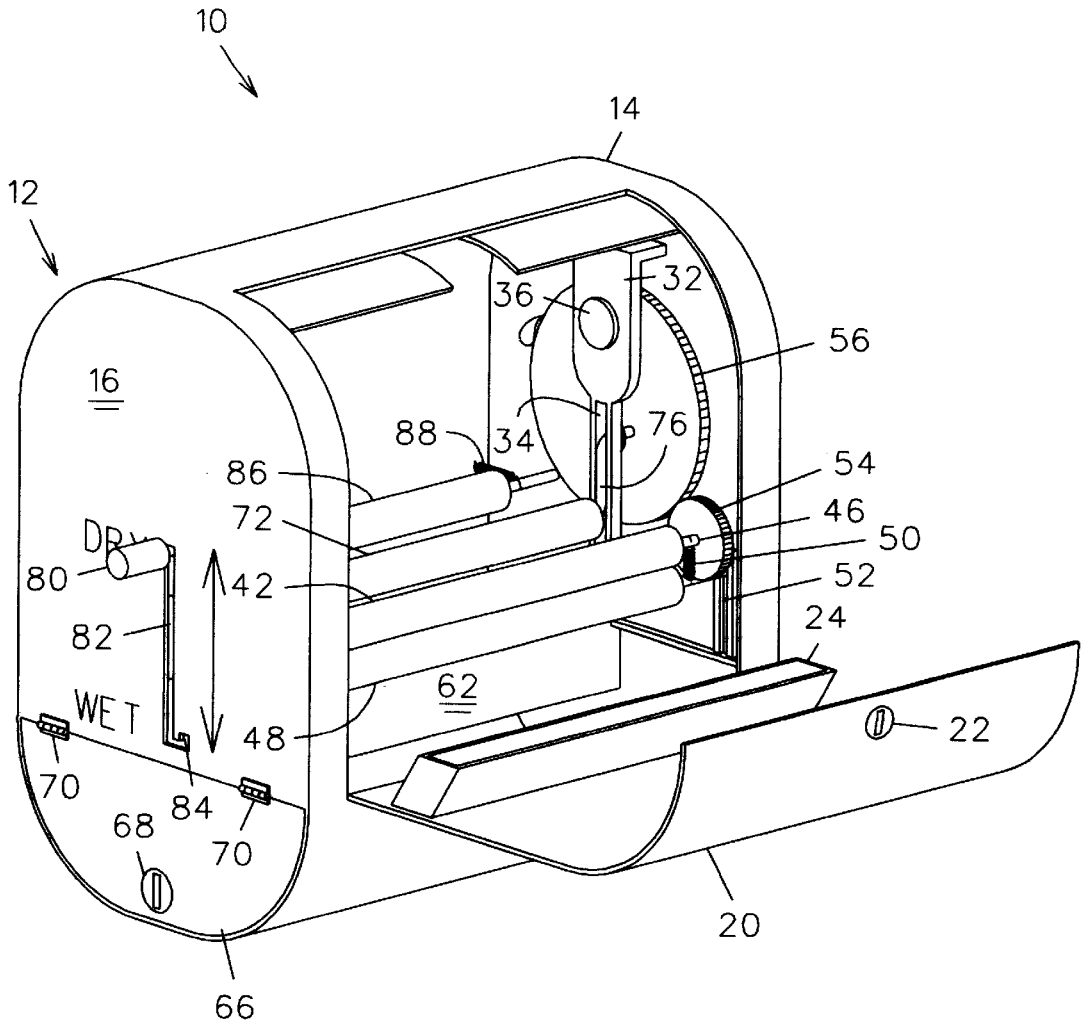
FIG. 6 is a perspective view of the dispensing apparatus as in FIG. 1 with the front section of the housing in an open configuration.
Figure 7:
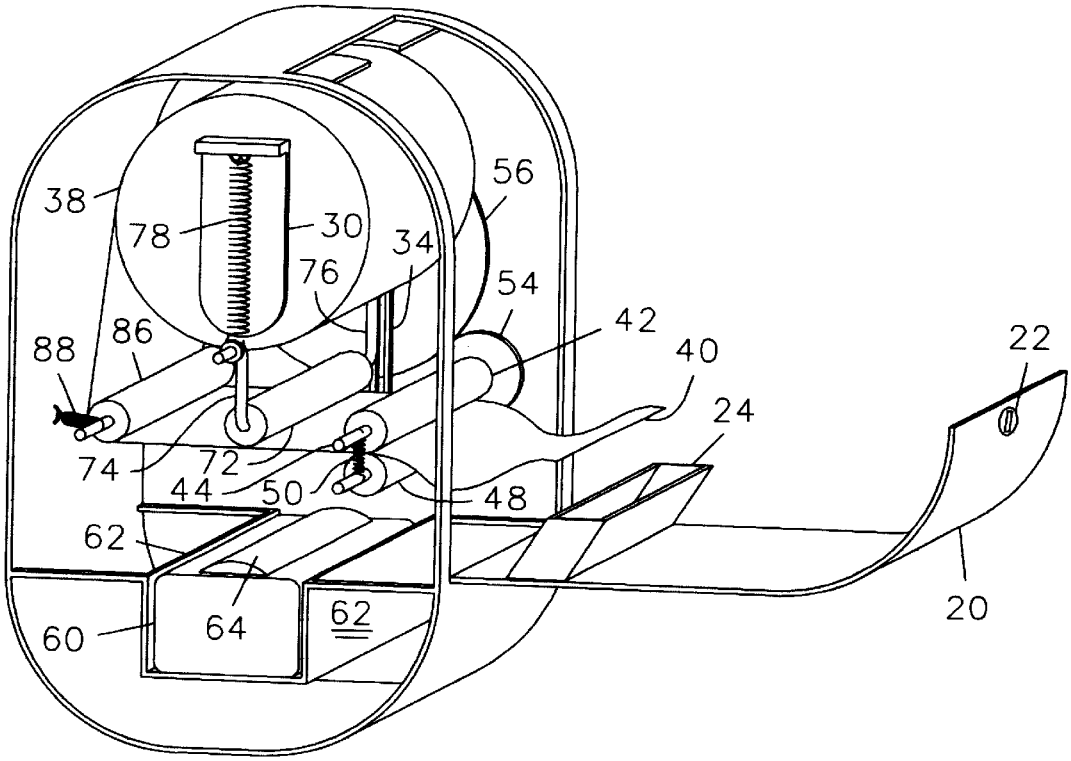
FIG. 7 is a perspective view of the dispensing apparatus as in FIG. 1 with the side panels removed to show the interior components of the apparatus.

First 30 and second 32 brackets are mounted to the interior surfaces of the first 16 and second 18 side walls, respectfully, and extend downwardly therefrom (FIGS. 6 and 7). A pair of hubs 36 are mounted to the interior surfaces of the brackets 30, 32 and define a pivot axis therebetween. It is understood that the brackets 30, 32 are constructed of a flexible plastic material such that a roll of tissue 38, e.g. paper towels, can be easily mounted or removed from between the hubs 36. The roll of tissue 38 rotates freely about the pivot axis of the hubs 36 as a free end 40 of the tissue is drawn through the dispenser apparatus 10 and through the opening 24, as to be more fully described below.

A pair of pinch rollers 42, 48 are mounted within the interior space of the housing 12 for drawing tissue therethrough. As best shown in FIGS. 6 and 7, a first end 44 of a first pinch roller 42 is pivotally attached to the interior surface of said first side wall 16 of the housing 12. An opposing end of the first pinch roller 42 is fixedly attached to a first gear 54, the first gear 54 being pivotally mounted to the interior surface of said second side wall 18. A second pinch roller 48 is coupled to the first pinch roller 42 with tension springs 50. Tissue extending from the roll of tissue 38 is sandwiched between the pinch rollers 42, 48. The pinch rollers 42, 48 bear against one another according to the tension of the springs 50 that are utilized. The type of springs used is dependent upon the thickness of the tissue used in the apparatus 10. The opposing ends of the second pinch roller 48 engage channels 52 formed in the first 16 and second 18 side walls for guiding vertical movement thereof.

Figure 5:
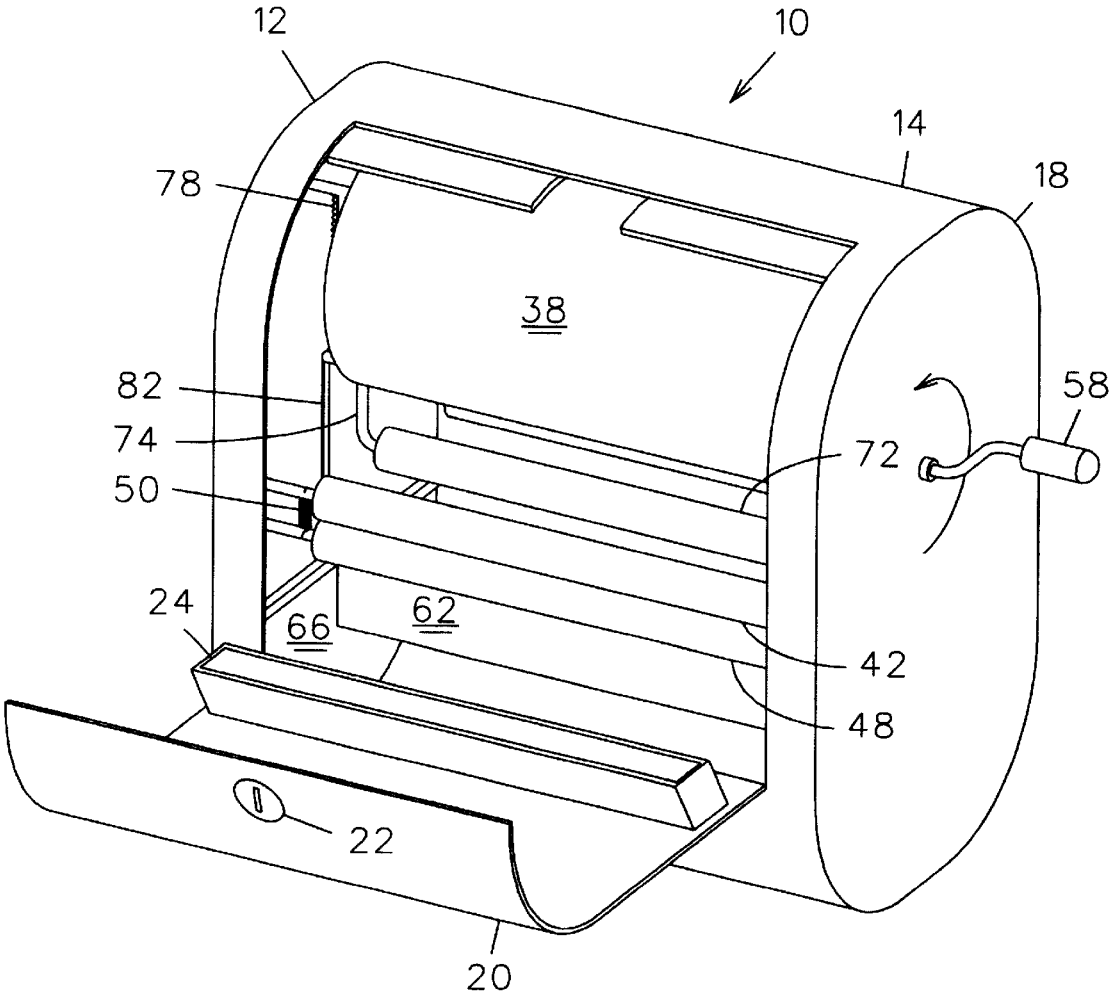
FIG. 5 is a perspective view of the dispensing apparatus as in FIG. 3 with the front section of the housing in an open configuration.

The first gear 54 includes teeth which mesh with the teeth of a second gear 56 pivotally mounted to the interior surface of the second side wall 19 and having a diameter larger than the diameter of the first gear 54. A crank handle 58 is coupled to the second gear 56 and extends through the second side wall 18 (FIG. 5). Rotation of the crank handle 58 by a user causes the gears and pinch rollers 42, 48 to pivot. Accordingly, a continuous stream of tissue is drawn through the housing by the pinch rollers 42, 48.

The dispensing apparatus 10 further includes a tension roller 86 pivotally mounted between the first 16 and second 18 side walls of the housing 12 (FIG. 7). The continuous stream of tissue extends about the tension roller 86 for keeping the tissue taut as it is drawn through the housing 12 by the pinch rollers 42, 48. The entire tension roller 86 can move in frontward and rearward directions as regulated by tension springs 88 so as to minimize unintentional tearing of tissue which may be caused by a forceful jerk of the tissue by a user.

A cartridge 60 of liquid disinfectant is slidably insertable within a channel that is formed in the lower portion of the housing 12, the channel formed by side walls 62 for guiding the cartridge 60 therein (FIG. 7). The cartridge 60 presents a generally rectangular configuration which forms a reservoir for a solution of disinfectant. The cartridge 60 includes a roller 64 partially extending from a top side thereof. The roller 64 is pivotally coupled to ends of the cartridge 60 such that rotation of the roller 64 causes the surface thereof to become wetted with the disinfectant solution. A side door 66 is pivotally coupled to the first side wall 16 of the housing with hinges 70 and includes a lock 68 for allowing selective access to the cartridge 60 for purpose of replacement.

The dispensing apparatus 10 further includes a roller 72 having oppositely disposed first 74 and second 76 offset arms (FIGS. 6 and 7). The roller 72 is coupled to the first bracket 30 with a spring 78 which extends between the first offset arm 74 and the upper end of the first bracket 30. The continuous sheet of tissue extends through the housing beneath the roller 72. A handle 80 is integral to the first offset arm 74 and extends normally through a vertical slot 82 in the first side wall 16 of the housing 12. The spring 78 is biased to keep the handle 80 at the upper end of the vertical slot 82 unless a user depresses the handle 80 to extend the spring 78. In this "up" position, the roller 72 is displaced from the cartridge roller 64 so that the tissue is not contacted by the cartridge roller 64. As the handle 80 is slidably moved downward in the vertical slot 82, the roller 72 presses the continuous sheet of tissue into engagement with the cartridge roller 64, thus wetting the tissue as it is drawn through the housing.

The lower end of the vertical slot 82 communicates with a notch 84 adjacent thereto such that the handle 80 can be releasably locked in the "down" position. The spring 78 causes the handle 80 and roller 72 to return to the "up" position when released from the notch 84. The second offset arm 76 extends into a guide track 34 which depends from the second bracket 32.

In preparing the dispensing apparatus 10 for use, the front door 20 is unlocked and pivoted outwardly to allow a roll of tissue 38 to be mounted between the hubs 36. The side door 66 is unlocked and pivoted outwardly to allow a cartridge 60 of disinfectant liquid to be inserted into the channel within the lower portion of the housing 12. The free end 40 of the roll of tissue 38 is directed to the rear of the tension roller 86, beneath the roller 72, between the pinch rollers 42, 48, and out through the opening in the front door 20. The front 20 and side 66 doors are closed and locked.

In use, a user selects whether a dry or wet tissue is desired by slidably moving the handle 80 up or down within the vertical slot 82. Leaving the handle 80 in the "up" position and then rotating the crank handle 58 in a counterclockwise direction results in dry tissue being drawn through the housing 12 and through the opening. A desired portion of tissue may be separated from the continuous sheet by pulling the tissue against the serrated edge 26. Alternatively, tissue with spaced apart perforations may also be used. Moving the handle 80 to a "down" position in the vertical slot 82 and, optionally, positioning the handle 80 in the adjacent notch 84 causes the roller 72 to press the tissue into contact with the cartridge roller 64. As a user rotates the crank handle 58, the tissue is wetted with disinfectant as the tissue is drawn across the cartridge roller 64. It should be appreciated that the cartridge roller 64 rotates as the tissue is drawn thereacross causing the roller 64 to be continuously saturated with disinfectant. The user can tear off a desired portion of the wet tissue as described above.

Accordingly, it can be seen that the dispenser apparatus of the present invention can selectably supply wet or dry tissues for sanitizing a toilet seat prior to use.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A dispensing apparatus, comprising:

a housing defining an interior space;

at least one hub mounted in said interior space;

a continuous sheet of tissue pivotally coupled to said hub and having a free end extending from said housing;

a first roller pivotally extending in said interior space and having a liquid thereon; and a second roller pivotally mounted in said housing and selectably movable between a first position bearing against said first roller and a second position displaced from said first roller, said sheet being sandwiched between said first and second rollers in said first position, whereby said liquid is transferred from said first roller to said sheet.

2. A dispensing apparatus as in claim 1 wherein said housing includes:

an arcuate body portion;

a front wall pivotally coupled to said body portion and having an opening for receiving said free end of said sheet of tissue therethrough; and first and second oppositely disposed side walls, said first side wall defining a vertical slot therein, said slot having a notch at a lower end thereof.

3. A dispensing apparatus as in claim 2 further includes a handle coupled to said second roller and extending through said slot, said handle slidable by a user between said lower end of said slot so as to place said second roller in said first position and an upper end of said slot so as to place said second roller in said second position, said handle adapted to selectably engage said notch for releasably holding said second roller in said first position.

4. A dispensing apparatus as in claim 2 wherein said opening includes a serrated edge for severing a portion of tissue from said sheet of tissue.

5. A dispensing apparatus as in claim 1 further comprises:

a gear assembly mounted in said interior space of said housing;

a third roller mounted to said gear assembly for pivotal rotation therewith;

a fourth roller pivotally mounted in said interior space and coupled to said third roller in a spring tension relationship, said continuous sheet of tissue sandwiched between said third and fourth rollers;

a crank handle coupled to said gear assembly and extending from said housing for dispensing said continuous sheet of tissue upon rotation of said crank handle by a user.

6. A dispensing apparatus as in claim 2 further includes:

a gear assembly pivotally mounted to an interior surface of said second wall of said housing;

a crank handle coupled to said gear assembly and extending outwardly through said second wall;

a third roller coupled to said gear assembly for rotation upon movement of said crank handle by a user; and a fourth roller pivotally mounted in said interior space and coupled to said third roller in a spring tension relationship, said continuous sheet of tissue being sandwiched between said third and fourth rollers and drawn therethrough upon rotation of said crank handle.

7. A dispensing apparatus as in claim 1 wherein said at least one hub comprises a pair of spaced apart hubs that define a pivot axis, said continuous sheet of tissue releasably coupled to said hubs and pivotal about said pivot axis upon extension of said sheet from said housing.

8. A dispensing apparatus as in claim 1 further includes a cartridge mounted in said interior space of said housing and displaced from said tissue, said cartridge having a reservoir of liquid therein; and said first roller pivotally coupled to said cartridge in communication with said reservoir such that said first roller is coated with said liquid upon rotation of said first roller.

9. A dispensing apparatus as in claim 8 wherein said cartridge is slidably removable from said housing.

10. A dispensing apparatus, comprising:

a housing having an opening in a front side and defining an interior space;

at least one hub mounted in said interior space and defining a pivot axis;

a coiled sheet of tissue releasably coupled to said hub and having a free end extending through said opening, said sheet being pivotal about said pivot axis upon extension of said sheet;

a first roller pivotally mounted in said interior space and having a disinfectant thereon; and a second roller pivotally mounted in said housing and selectably movable between a first position bearing against said first roller and a second position displaced from said first roller, said sheet of tissue being sandwiched between said first and second rollers when said second roller is in said first position for transferring said disinfectant from said first roller to said sheet of tissue as said sheet is drawn across said first roller.

11. A dispensing apparatus as in claim 10 wherein said housing includes an arcuate bottom and first and second side walls extending from said bottom, said first side wall defining a vertical slot in communication with a notch adjacent a lower end of said vertical slot.

12. A dispensing apparatus as in claim 10 wherein said coating means includes a cartridge removably positioned in said interior space of said housing and having a quantity of disinfectant therein, said first roller pivotally coupled to said cartridge and in communication with said disinfectant such that said first roller is coated with said disinfectant upon rotation of said first roller.

13. A dispensing apparatus as in claim 10 includes a handle coupled to said second roller and extending through said vertical slot, said handle slidable by a user between said lower end of said slot so as to place said second roller in said first position and an upper end of said vertical slot so as to place said second roller in said second position, said handle adapted to selectably engage said notch for releasably holding said second roller in said first position.

14. A dispensing apparatus as in claim 10 further includes:

a gear assembly pivotally mounted to an interior surface of said second wall of said housing;

a crank handle coupled to said gear assembly and extending outwardly through said second wall;

a third roller coupled to said gear assembly for rotation upon movement of said crank handle by a user; and a fourth roller pivotally mounted in said interior space and coupled to said third roller in a spring tension relationship, said sheet of tissue being sandwiched between said third and fourth rollers and drawn therethrough upon rotation of said crank handle.

15. An apparatus for dispensing cleaning tissue, comprising:

a housing having a horizontal slot extending through a front side thereof and defining an interior space, said housing having first and second side walls extending upwardly from a bottom wall, said first side defining a vertical slot, a lower end of said vertical slot communicating with a notch adjacent said vertical slot;

a pair of oppositely disposed spaced apart hubs mounted in said interior space and defining a pivot axis;

a bolt of tissue releasably coupled to said hubs and pivotal about said pivot axis, a free end of said bolt of tissue extending through said opening upon an uncoiling of said bolt of tissue;

a cartridge mounted in said interior space of said housing and displaced from said tissue, said cartridge having a quantity of disinfectant therein;

a first roller pivotally coupled to said cartridge in communication with said disinfectant such that said first roller is coated with said disinfectant upon rotation of said first roller; and a second roller pivotally mounted in said interior space and selectably movable by a user between a first position bearing against said first roller and a second position displaced from said first roller such that said tissue is sandwiched between said first and second rollers when said second roller is in said first position, whereby said tissue is coated with disinfectant as said bolt of tissue is uncoiled.

16. An apparatus as in claim 15 further includes a handle coupled to said second roller and extending through said vertical slot, said handle slidable by a user between said lower end of said vertical slot so as to place said second roller in said first position and an upper end of said slot so as to place said second roller in said second position, said handle adapted to selectably engage said notch for releasably holding said second roller in said first position.

17. An apparatus as in claim 15 further includes:

a gear assembly pivotally mounted to an interior surface of said second wall of said housing;

a crank handle coupled to said gear assembly and extending outwardly through said second wall;

a third roller coupled to said gear assembly for rotation upon movement of said crank handle by a user; and a fourth roller pivotally mounted in said interior space and coupled to said third roller in a spring tension relationship, said bolt of tissue being sandwiched between said third and fourth rollers, whereby said bolt of tissue is uncoiled upon rotation of said crank handle and drawn across said first roller when said second roller is in said first position.

18. An apparatus as in claim 15 wherein said horizontal slot includes a serrated edge for severing a portion of tissue from said bolt of tissue.

19. The apparatus as in claim 15 wherein said cartridge is removable from said housing.

* * * * *